US008381543B2

(12) United States Patent
Ransbarger et al.

(10) Patent No.: US 8,381,543 B2
(45) Date of Patent: Feb. 26, 2013

(54) SYSTEM FOR ENHANCED FUEL GAS COMPOSITION CONTROL IN AN LNG FACILITY

(75) Inventors: Weldon L. Ransbarger, Houston, TX (US); Jon M. Mock, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 1392 days.

(21) Appl. No.: 11/955,141

(22) Filed: Dec. 12, 2007

(65) Prior Publication Data

US 2009/0151390 A1 Jun. 18, 2009

(51) Int. Cl.
*F25J 1/00* (2006.01)
*F02C 7/26* (2006.01)

(52) U.S. Cl. ..... 62/611; 62/612; 60/776

(58) Field of Classification Search ..... 62/611, 62/612, 618, 619, 620, 624; 95/4, 47, 50
See application file for complete search history.

(56) References Cited

U.S. PATENT DOCUMENTS

| | | | | |
|---|---|---|---|---|
| 4,370,150 | A | 1/1983 | Fenstermaker | |
| 4,932,213 | A * | 6/1990 | Summers et al. | 62/619 |
| 5,647,227 | A | 7/1997 | Lokhandwala | |
| 5,669,958 | A * | 9/1997 | Baker et al. | 95/50 |
| 5,879,431 | A | 3/1999 | Baker et al. | |
| 6,112,549 | A | 9/2000 | Yao | |
| 6,779,333 | B2 | 8/2004 | Gerhold | |
| 7,210,311 | B2 * | 5/2007 | Wilkinson | 62/611 |
| 2003/0177786 | A1 * | 9/2003 | O'Brien | 62/620 |
| 2003/0217555 | A1 * | 11/2003 | Gerhold | 60/776 |
| 2004/0003625 | A1 * | 1/2004 | Fischer et al. | 62/612 |
| 2004/0237581 | A1 * | 12/2004 | Paradowski | 62/620 |
| 2005/0204625 | A1 * | 9/2005 | Briscoe et al. | 48/127.3 |
| 2005/0268648 | A1 * | 12/2005 | Eaton | 62/612 |
| 2005/0279132 | A1 * | 12/2005 | Eaton et al. | 62/613 |
| 2007/0237696 | A1 * | 10/2007 | Payton | 423/228 |
| 2010/0077766 | A1 * | 4/2010 | Panuccio et al. | 60/780 |

OTHER PUBLICATIONS

Kaaeid A. Lokhandwala and Marc L. Jacobs; New Membrane Applications in Gas Processing; 12 pages; Spring 2000; Membrane Technology & Research, Inc., Menlo Park, CA.

Pat Hale and Kaaeid Lokhandwala; Advances in Membrane Materials Provide New Solutions in the Gas Business; 17 pages; Feb. 2004; Randall Gas Technologies—ABB Lummus Global Inc. and Membrane Technology and Research, Inc., Menlo Park, CA.

Kaaeid Lokhandwala, Ankur Jariwala, and Richard W. Baker; Only Raw Sour Gas Available for Engine Fuel? Proven Membrane Process Cleans Gas for Engines; pp. 227-236; Mar. 1, 2006; Membrane Technology and Research, Inc., Menlo Park, CA.

Kaaeid A. Lokhandwala, Andre Da Costa, Marc Jacobs, and Richard Baker; Membrane Systems for Nitrogen Rejection; 9 pages; Nov. 2005; Membrane Technology and Research, Inc., Menlo Park, CA.

* cited by examiner

*Primary Examiner* — Frantz Jules
*Assistant Examiner* — Alexandro Acevedo Torres
(74) *Attorney, Agent, or Firm* — ConocoPhillips Company

(57) ABSTRACT

An LNG facility employing an enhanced fuel gas control system. The enhanced fuel gas control system is operable to produce fuel gas having a substantially constant Modified Wobbe Index (MWI) during start-up and steady-state operation of the LNG facility by processing one or more intermediate process streams in a fuel gas separator. In one embodiment, the fuel gas separator employs a hydrocarbon-separating membrane, which can remove heavy hydrocarbons and/or concentrate nitrogen from the incoming process streams.

16 Claims, 2 Drawing Sheets

SYSTEM FOR ENHANCED FUEL GAS COMPOSITION CONTROL IN AN LNG FACILITY

BACKGROUND OF THE INVENTION

1. Field of the Invention

This invention relates to methods and apparatuses for liquefying natural gas. In another aspect, the invention concerns a liquefied natural gas (LNG) facility employing a system for enhanced fuel gas composition control.

2. Description of the Related Art

Cryogenic liquefaction is commonly used to convert natural gas into a more convenient form for transportation and/or storage. Because liquefying natural gas greatly reduces its specific volume, large quantities of natural gas can be economically transported and/or stored in liquefied form.

Transporting natural gas in its liquefied form can effectively link a natural gas source with a distant market when the source and market are not connected by a pipeline. This situation commonly arises when the source of natural gas and the market for the natural gas are separated by large bodies of water. In such cases, liquefied natural gas (LNG) can be transported from the source to the market using specially designed ocean-going LNG tankers.

Storing natural gas in its liquefied form can help balance out periodic fluctuations in natural gas supply and demand. In particular, LNG can be "stockpiled" for use when natural gas demand is low and/or supply is high. As a result, future demand peaks can be met with LNG from storage, which can be vaporized as demand requires.

Several methods exist for liquefying natural gas. Some methods produce a pressurized LNG (PLNG) product that is useful, but requires expensive pressure-containing vessels for storage and transportation. Other methods produce an LNG product having a pressure at or near atmospheric pressure. In general, these non-pressurized LNG production methods involve cooling a natural gas stream via indirect heat exchange with one or more refrigerants and then expanding the cooled natural gas stream to near atmospheric pressure. In addition, most LNG facilities employ one or more systems to remove contaminants (e.g., water, acid gases, nitrogen, and ethane and heavier components) from the natural gas stream at different points during the liquefaction process.

The cooling required by LNG facilities to liquefy the natural gas stream is typically provided by one or more mechanical refrigeration cycles. These mechanical refrigeration cycles generally employ one or more refrigerant compressors, which are usually driven by gas turbines. To power the gas turbines, most LNG facilities utilize one or more internal (i.e., intermediate) process streams as fuel gas. Because the intermediate streams processed for fuel gas originate from several locations within the LNG facility, the final composition of the processed fuel gas can vary widely. As most process equipment requiring fuel gas (i.e., a gas turbine) is typically designed to operate with fuel gas having a reasonably constant composition, producing fuel gas having a widely varying composition can result in operational problems for the LNG facility.

One proposed solution for managing fuel gas streams having different compositions is to design the gas turbines to operate under multiple sets of conditions. For example, most gas turbines can be designed to have a dual fuel nozzle configuration to accommodate multiple possible fuel gas compositions without impacting turbine performance. However, gas turbines designed to operate with multiple fuel gas compositions are more expensive and more complex to operate than conventional gas turbines.

Thus, a need exists for a system for controlling fuel gas composition in an LNG facility in a way that minimizes capital and operating costs while maintaining or increasing plant operating flexibility.

SUMMARY OF THE INVENTION

In one embodiment of the present invention, there is provided a process for liquefying a natural gas stream in an LNG facility, the process comprising: (a) separating a first predominantly methane stream into a first lights stream and a first heavies stream in a fuel gas separator; (b) burning a first fuel gas stream comprising at least a portion of the first lights stream in a gas turbine; (c) separating a second predominantly methane stream into a second lights stream and a second heavies stream in the fuel gas separator; and (d) burning a second fuel gas stream comprising at least a portion of the second lights stream in the gas turbine, wherein the difference in Modified Wobbe Index (MWI) between the first and the second lights streams is less than the difference in MWI between the first and the second predominantly methane streams.

In another embodiment of the present invention, there is provided a process for liquefying a natural gas stream in an LNG facility, the process comprising: (a) cooling at least a portion of the natural gas stream via indirect heat exchange in an open-loop methane refrigeration cycle to thereby produce a cooled natural gas stream; (b) separating at least a portion of the cooled natural gas stream into a refrigerant stream and a product stream; (c) separating at least a portion of the refrigerant stream in a separator comprising a hydrocarbon-separating membrane to thereby produce a nitrogen-rich stream and a nitrogen-depleted stream; and (d) returning at least a portion of the nitrogen-depleted stream back to the open-loop methane refrigeration cycle.

In yet another embodiment of the present invention, there is provided a process for liquefying a natural gas stream in an LNG facility, the process comprising: (a) cooling the natural gas stream in a first refrigeration cycle via indirect heat exchange with a first refrigerant to thereby produce a cooled natural gas stream; (b) separating at least a portion of the cooled natural gas stream in a fuel gas separator comprising a hydrocarbon-separating membrane to thereby produce a nitrogen-rich stream and a nitrogen-depleted stream; and (c) burning at least a portion of the nitrogen-rich stream in a gas turbine, wherein the gas turbine is used to power a refrigerant compressor of the first refrigeration cycle.

In a further embodiment of the present invention, there is provided an LNG facility for liquefying a natural gas stream flowing from a natural gas feed inlet of the LNG facility to an LNG outlet of the LNG facility. The LNG facility comprises a main flow path, an open-loop refrigeration cycle, and a fuel gas separator. The main flow path transports at least a portion of the natural gas stream from the natural gas feed inlet to the LNG outlet. The open-loop refrigeration cycle is operable to cool the natural gas stream flowing along the main flow path and the fuel gas separator defines a feed gas inlet, a fuel gas outlet, and a heavies outlet. The LNG facility is shiftable between a start-up configuration and a steady-state configuration. In the start-up configuration, the feed gas inlet is in fluid flow communication with the main flow path upstream of the open-loop refrigeration cycle, and, in the steady-state configuration, the feed gas inlet is in fluid flow communication with the open-loop refrigeration cycle.

BRIEF DESCRIPTION OF THE FIGURES

Certain embodiments of the present invention are described in detail below with reference to the enclosed figures, wherein.

Figure 1:
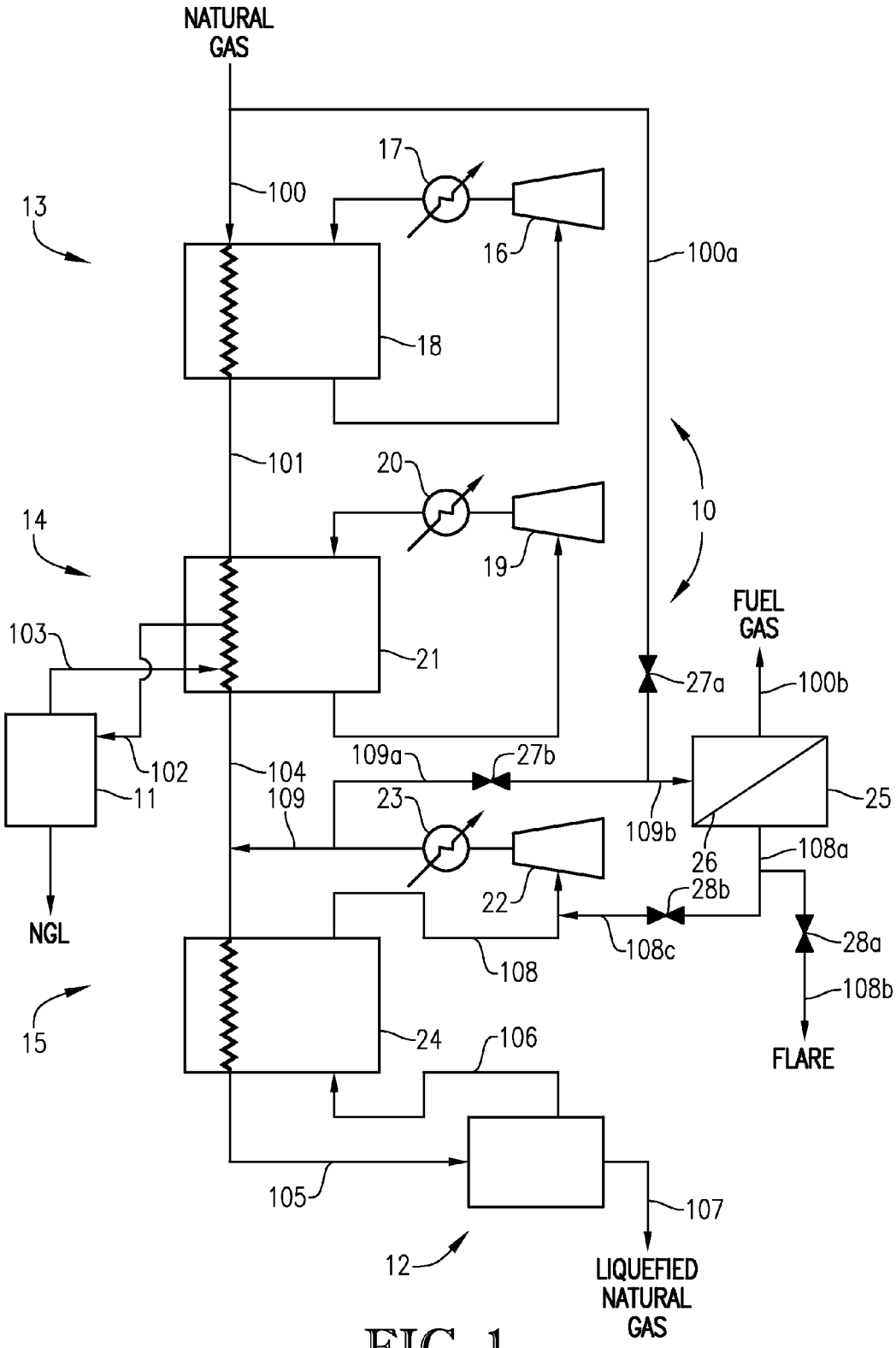
FIG. 1 is a simplified overview of a cascade-type LNG facility configured in accordance with one embodiment of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION

The present invention can be implemented in a facility used to cool natural gas to its liquefaction temperature to thereby produce liquefied natural gas (LNG). The LNG facility generally employs one or more refrigerants to extract heat from the natural gas and then reject the heat to the environment. Numerous configurations of LNG systems exist, and the present invention may be implemented in many different types of LNG systems.

In one embodiment, the present invention can be implemented in a mixed refrigerant LNG system. Examples of mixed refrigerant processes can include, but are not limited to, a single refrigeration system using a mixed refrigerant, a propane pre-cooled mixed refrigerant system, and a dual mixed refrigerant system.

In another embodiment, the present invention is implemented in a cascade LNG system employing a cascade-type refrigeration process using one or more pure component refrigerants. The refrigerants utilized in cascade-type refrigeration processes can have successively lower boiling points in order to maximize heat removal from the natural gas stream being liquefied. Additionally, cascade-type refrigeration processes can include some level of heat integration. For example, a cascade-type refrigeration process can cool one or more refrigerants having a higher volatility via indirect heat exchange with one or more refrigerants having a lower volatility. In addition to cooling the natural gas stream via indirect heat exchange with one or more refrigerants, cascade and mixed-refrigerant LNG systems can employ one or more expansion cooling stages to simultaneously cool the LNG while reducing its pressure to near atmospheric pressure.

FIG. 1 illustrates one embodiment of a simplified LNG facility employing a system for enhanced control of fuel gas composition. The cascade LNG facility of FIG. 1 generally comprises a cascade cooling section 10, a heavies removal zone 11, and an expansion cooling section 12. Cascade cooling section 10 is depicted as comprising a first mechanical refrigeration cycle 13, a second mechanical refrigeration cycle 14, and a third mechanical refrigeration cycle 15. In general, first, second, and third refrigeration cycles 13, 14, 15 can be closed-loop refrigeration cycles, open-loop refrigeration cycles, or any combination thereof. In one embodiment of the present invention, first and second refrigeration cycles 13 and 14 can be closed-loop cycles, and third refrigeration cycle 15 can be an open-loop cycle that utilizes a refrigerant comprising at least a portion of the natural gas feed stream undergoing liquefaction.

In accordance with one embodiment of the present invention, first, second, and third refrigeration cycles 13, 14, 15 can employ respective first, second, and third refrigerants having successively lower boiling points. For example, the first, second, and third refrigerants can have mid-range boiling points at standard pressure (i.e., mid-range standard boiling points) within about 20° F., within about 10° F., or within 5° F. of the standard boiling points of propane, ethylene, and methane, respectively. In one embodiment, the first refrigerant can comprise at least about 75 mole percent, at least about 90 mole percent, at least 95 mole percent, or can consist essentially of propane, propylene, or mixtures thereof. The second refrigerant can comprise at least about 75 mole percent, at least about 90 mole percent, at least 95 mole percent, or can consist essentially of ethane, ethylene, or mixtures thereof. The third refrigerant can comprise at least about 75 mole percent, at least about 90 mole percent, at least 95 mole percent, or can consist essentially of methane.

Referring now to FIG. 1, first refrigeration cycle 13 can comprise a first refrigerant compressor 16, a first cooler 17, and a first refrigerant chiller 18. First refrigerant compressor 16 can discharge a stream of compressed first refrigerant, which can subsequently be cooled and at least partially liquefied in cooler 17. The resulting refrigerant stream can then enter first refrigerant chiller 18, wherein at least a portion of the refrigerant stream can cool the incoming natural gas stream in conduit 100 via indirect heat exchange with the vaporizing first refrigerant. The gaseous refrigerant can exit first refrigerant chiller 18 and can then be routed to an inlet port of first refrigerant compressor 16 to be recirculated as previously described.

First refrigerant chiller 18 can comprise one or more cooling stages operable to reduce the temperature of the incoming natural gas stream in conduit 100 by about 40 to about 210° F., about 50 to about 190° F., or 75 to 150° F. Typically, the natural gas entering first refrigerant chiller 18 via conduit 100 can have a temperature in the range of from about 0 to about 200° F., about 20 to about 180° F., or 50 to 165° F., while the temperature of the cooled natural gas stream exiting first refrigerant chiller 18 can be in the range of from about −65 to about 0° F., about −50 to about −10° F., or −35 to −15° F. In general, the pressure of the natural gas stream in conduit 100 can be in the range of from about 100 to about 3,000 pounds per square inch absolute (psia), about 250 to about 1,000 psia, or 400 to 800 psia. Because the pressure drop across first refrigerant chiller 18 can be less than about 100 psi, less than about 50 psi, or less than 25 psi, the cooled natural gas stream in conduit 101 can have substantially the same pressure as the natural gas stream in conduit 100.

As illustrated in FIG. 1, the cooled natural gas stream (also referred to herein as the "cooled predominantly methane stream") exiting first refrigeration cycle 13 can then enter second refrigeration cycle 14, which can comprise a second refrigerant compressor 19, a second cooler 20, and a second refrigerant chiller 21. Compressed refrigerant can be discharged from second refrigerant compressor 19 and can subsequently be cooled and at least partially liquefied in cooler 20 prior to entering second refrigerant chiller 21. Second refrigerant chiller 21 can employ a plurality of cooling stages to progressively reduce the temperature of the predominantly methane stream in conduit 101 by about 50 to about 180° F., about 65 to about 150° F., or 95 to 125° F. via indirect heat exchange with the vaporizing second refrigerant. As shown in FIG. 1, the vaporized second refrigerant can then be returned to an inlet port of second refrigerant compressor 19 prior to being recirculated in second refrigeration cycle 14, as previously described.

The natural gas feed stream in conduit 100 will usually contain ethane and heavier components (C2+), which can result in the formation of a C2+ rich liquid phase in one or more of the cooling stages of second refrigeration cycle 14. In order to remove the undesired heavies material from the predominantly methane stream prior to complete liquefaction, at least a portion of the natural gas stream passing through second refrigerant chiller 21 can be withdrawn via conduit 102 and processed in heavies removal zone 11, as shown in FIG. 1. The natural gas stream in conduit 102 can have a temperature in the range of from about −160 to about −50° F., about −140 to about −65° F., or −115 to −85° F. and a pressure that is within about 5 percent, about 10 percent, or 15 percent of the pressure of the natural gas feed stream in conduit 100.

Heavies removal zone 11 can comprise one or more gas-liquid separators operable to remove at least a portion of the heavy hydrocarbon material from the predominantly methane stream. Typically, heavies removal zone 11 can be operated to remove benzene and other high molecular weight aromatic components, which can freeze in subsequent liquefaction steps and plug downstream process equipment. In addition, heavies removal zone 11 can be operated to recover the heavy hydrocarbons in a natural gas liquids (NGL) product stream. Examples of typical hydrocarbon components included in NGL streams can include ethane, propane, butane isomers, pentane isomers, and hexane and heavier components (i.e., C6+). The extent of NGL recovery from the predominantly methane stream ultimately impacts one or more final characteristics of the LNG product, such as, for example, Wobbe index, BTU content, higher heating value (HHV), ethane content, and the like. In one embodiment, the NGL product stream exiting heavies removal zone 11 can be subjected to further fractionation in order to obtain one or more pure component streams. Often, NGL product streams and/or their constituents can be used as gasoline blendstock.

The predominantly methane stream exiting heavies removal zone 11 via conduit 103 can comprise less than about 1 weight percent, less than about 0.5 weight percent, less than about 0.1 weight percent, or less than 0.01 weight percent of C6+ material, based on the total weight of the stream. Typically, the predominantly methane stream in conduit 103 can have a temperature in the range of from about −140 to about −50° F., about −125 to about −60° F., or −110 to −75° F. and a pressure in the range of from about 200 to about 1,200 psia, about 350 to about 850 psia, or 500 to 700 psia. As shown in FIG. 1, the stream exiting heavies removal zone 12 via conduit 103 can subsequently be routed back to second refrigeration cycle 14, wherein the stream can be further cooled via second refrigerant chiller 21. In one embodiment, the stream exiting second refrigerant chiller 21 via conduit 104 can be completely liquefied and can have a temperature in the range of from about −205 to about −70° F., about −175 to about −95° F., or −140 to −125° F. Generally, the stream in conduit 104 can be at approximately the same pressure the natural gas stream entering the LNG facility in conduit 100.

As illustrated in FIG. 1, the pressurized LNG-bearing stream in conduit 104 can combine with a yet-to-be-discussed stream in conduit 109 prior to entering third refrigeration cycle 15, which is depicted as generally comprising a third refrigerant compressor 22, a cooler 23, and a third refrigerant chiller 24. Compressed refrigerant discharged from third refrigerant compressor 22 enters cooler 23, wherein the refrigerant stream is cooled and at least partially liquefied prior to entering third refrigerant chiller 24. Third refrigerant chiller 24 can comprise one or more cooling stages operable to subcool the pressurized predominantly methane stream via indirect heat exchange with the vaporizing refrigerant. In one embodiment, the temperature of the pressurized LNG-bearing stream can be reduced by about 2 to about 60° F., about 5 to about 50° F., or 10 to 40° F. in third refrigerant chiller 24. In general, the temperature of the pressurized LNG-bearing stream exiting third refrigerant chiller 24 via conduit 105 can be in the range of from about −275 to about −75° F., about −225 to about −100° F., or −200 to −125° F.

As shown in FIG. 1, the pressurized LNG-bearing stream in conduit 105 can be then routed to expansion cooling section 12, wherein the stream is subcooled via sequential pressure reduction to near atmospheric pressure by passage through one or more expansion stages. In one embodiment, each expansion stage can reduce the temperature of the LNG-bearing stream by about 10 to about 60° F., about 15 to about 50° F., or 20 to 40° F. Each expansion stage comprises one or more expanders, which reduce the pressure of the liquefied stream to thereby evaporate or flash a portion thereof. Examples of suitable expanders can include, but are not limited to, Joule-Thompson valves, venturi nozzles, and turboexpanders. Expansion section 12 can employ any number of expansion stages and one or more expansion stages may be integrated with one or more cooling stages of third refrigerant chiller 24. In one embodiment of the present invention, expansion section 12 can reduce the pressure of the LNG-bearing stream in conduit 105 by about 75 to about 450 psi, about 125 to about 300 psi, or 150 to 225 psi.

Each expansion stage may additionally employ one or more vapor-liquid separators operable to separate the vapor phase (i.e., the flash gas stream) from the cooled liquid stream. As shown in FIG. 1, the cooled liquid stream exiting expansion section 12 via conduit 107 comprises LNG. In one embodiment, the LNG in conduit 107 can have a temperature in the range of from about −200 to about −300° F., about −225 to about −275° F., or −240 to −260° F. and a pressure in the range of from about 0 to about 40 psia, about 5 to about 25 psia, 10 to 20 psia, or about atmospheric. The LNG in conduit 107 can subsequently be routed to storage and/or shipped to another location via pipeline, ocean-going vessel, truck, or any other suitable transportation means. In one embodiment, at least a portion of the LNG can be subsequently vaporized for uses in applications requiring vapor-phase natural gas.

As previously discussed, third refrigeration cycle 15 can comprise an open-loop refrigeration cycle, closed-loop refrigeration cycle, or any combination thereof. When third refrigeration cycle 15 comprises a closed-loop refrigeration cycle, the flash gas stream can be used as fuel within the facility or routed downstream for storage, further processing, and/or disposal. When third refrigeration cycle 15 comprises an open-loop refrigeration cycle, at least a portion of the flash gas stream exiting expansion section 12 can be used as a refrigerant to cool at least a portion of the natural gas stream in conduit 104. Generally, when third refrigerant cycle 15 comprises an open-loop cycle, the third refrigerant can comprise at least 50 weight percent, at least about 75 weight percent, or at least 90 weight percent of flash gas from expansion section 12, based on the total weight of the stream. As illustrated in FIG. 1, the flash gas exiting expansion section 12 via conduit 106 can enter third refrigerant chiller 24, wherein the stream can cool at least a portion of the natural gas stream entering third refrigerant chiller 24 via conduit 104. The resulting warmed refrigerant stream can then exit third refrigerant chiller 24 via conduit 108 and can thereafter be routed to an inlet port of third refrigerant compressor 22. As shown in FIG. 1, third refrigerant compressor 22 discharges a stream of compressed third refrigerant, which is thereafter cooled in cooler 23. The resulting cooled methane stream in conduit 109 can then combine with the natural gas stream in conduit 104 prior to entering third refrigerant chiller 24, as previously discussed.

In one embodiment, the LNG facility depicted in FIG. 1 can comprise a fuel gas separator 25. Fuel gas separator 25 can be any separation device capable of removing at least one component from an incoming gas stream in conduit 109*b* to thereby produce a lights stream, which exits separator 25 via conduit 100*b*, and a heavies stream, which exits separator 25 via conduit 108*a*. In accordance with one embodiment, the lights stream in conduit 100*b* can be employed as a fuel gas stream in the LNG facility depicted in FIG. 1. Fuel gas separator 25 can be used to control the relative concentrations of nitrogen, methane, and C2+ in the fuel gas stream. In order to do so, fuel gas separator 25 can employ a hydrocarbon-separating membrane 26 capable of preferentially separating (i.e., permeating) hydrocarbon material from other components (e.g., nitrogen) in the incoming gas stream. In one embodiment of the present invention, hydrocarbon-separating membrane 26 can have a methane-to-nitrogen selectivity of greater than about 1.5, greater than about 2.0, or greater than 2.5 at a temperature of 75° F. In addition, hydrocarbon-separating membrane 26 can have a pressure-normalized transmembrane methane flux of at least about $1.0\times10^{-6}$ cubic centimeters (at standard temperature and pressure) per square centimeter per second per centimeter of mercury ($cm^3$(STP)/$cm^2$·s·cmHg), at least about $1.0\times10^{-5}$ $cm^3$(STP)/$cm^2$·s·cmHg, or at least $2.5\times10^{-5}$ $cm^3$(STP)/$cm^2$·s·cmHg at a temperature of 75° F.

Hydrocarbon-separating membrane 26 can comprise rubber or rubber-like material (i.e., a rubbery membrane) or a "super-glassy" polymer material (i.e., a super-glassy membrane). In one embodiment, the rubbery materials employed to produce the rubbery membrane can have a glass transition temperature (Tg) less than about −55° F., less than about −110° F., or less than −145° F. at a pressure of 14.7 psia. Examples of rubbery materials suitable for use in the present invention include, but are not limited to, siloxane polymers such as poly(dimethylsiloxane), poly(methyloctyl)siloxane, poly(methylphenylsiloxane), poly(dimethylsiloxane-dimethylstyrene), poly(siloctylene-siloxane), poly(p-silphenylene-siloxane), polymethylene, poly(dimethyl-silylenemethylene), cis-poly(1-butylene), poly (dimethoxyphosphazene), poly(octa-decylmethacrylate), poly(oxytetramethylenedithiotetramethylene), methylene-ethylene copolymers, polyisoprene, polybutadiene, and natural rubber.

Super-glassy polymers are characterized by having a rigid structure and a Tg greater than about 200° F., greater than about 300° F., greater than about 375° F., or greater than 425° F. In addition, super-glassy polymers have a methane permeability of at least about 1,000 Barrer, at least about 1,250 Barrer, or at least 2,000 Barrer, wherein a Barrer is $10^{-10}$ $cm^3$ (STP)·cm/$cm^2$·s·cmHg. Super-glassy polymers can comprise substituted acetylenes, silicon-containing polyacetylenes, germanium-containing polyacetylenes, and copolymers of any of the above with each other or any other polymer material. Polytrimethylsilylpropyne (PTMSP) is one example of a specific super-glassy polymer.

In one embodiment of the present invention, hydrocarbon-separating membrane 26 can be formed as a flat sheet, hollow fiber, or any other convenient form. Hydrocarbon-separating membrane 26 can be housed in any type of module, including, but not limited to, a plate-and-frame module, a potted fiber module, or a spiral-wound module. Rubbery and super-glassy hydrocarbon-separating membranes suitable for use in the present invention are commercially available from Membrane Technology and Research, Inc. in Menlo Park, Calif.

During start-up of the LNG facility depicted in FIG. 1, a portion of the natural gas feed stream in conduit 100 can be withdrawn prior to entering first refrigeration cycle 13 via conduit 100*a* for use as fuel gas. Because the withdrawn portion of the natural gas stream in conduit 100*a* has not passed through heavies removal zone 11, the stream in conduit 100*a* can have a C2+ content greater than about 0.5 mole percent, greater than about 1 mole percent, greater than about 2 mole percent, or greater than 5 mole percent, based on the total moles of the stream in conduit 100*a*. The stream in conduit 100*a*, which can have a pressure in the range of from about 100 to about 3,000 pounds per square inch absolute (psia), about 250 to about 1,000 psia, or 400 to 800 psia and a temperature in the range of from about 0 to about 250° F., about 20 to about 175° F., or 50 to 125° F., can subsequently be routed via conduit 109*b* into fuel gas separator 25, wherein the C2+ components are preferentially permeated through hydrocarbon-separating membrane 26. The driving force for the transmembrane permeation can be provided by maintaining the permeate side of hydrocarbon-separating membrane 26 at a pressure in the range of from about 25 to about 200 psia, about 50 to about 150 psia, or 75 to 125 psia.

During start-up, the molar ratio of the C2+ content of the portion of the feed stream not passing through the membrane (i.e., the retentate stream) to the C2+ content of the feed stream entering fuel gas separator 25 can be less than about 0.45:1, less than about 0.35:1, less than about 0.25:1, or less than 0.10:1. The heavies-depleted retentate stream, which can comprise less than about 10 mole percent, less than about 5 mole percent, less than about 2 mole percent, or less than 1 mole percent of C2+ material, can subsequently be employed as a fuel gas stream within the LNG facility. The portion of the feed gas stream passing through hydrocarbon-separating membrane 26 (i.e., the permeate stream) in conduit 100*b* can comprise at least about 50 mole percent, at least about 75 mole percent, at least about 90 mole percent, or at least about 95 mole percent methane and heavier hydrocarbon components. The heavies-rich permeate stream exiting fuel gas separator 25 via conduit 108*a* can be routed to a hydrocarbon disposal device, such as, for example a flare (not shown) via conduit 108*b*.

During steady-state operation of the LNG facility, fuel gas separator 25 can be used to remove nitrogen from the methane refrigeration cycle. When the methane refrigeration cycle comprises an open-loop refrigeration cycle, as depicted in FIG. 1, nitrogen can build up in the refrigerant and adversely impact the refrigerant's effectiveness. In order to remove unwanted nitrogen from the methane refrigeration cycle, a stream of refrigerant can be withdrawn and routed to fuel gas separator 25 via conduit 109*a*. The stream in conduit 109*a* generally has a temperature in the range of from about 0 to about 250° F., about 20 to about 175° F., or about 75 to about 150° F. and a pressure in the range of from about 50 to about 1200 psia, about 250 to about 1000 psia, or about 400 to about 800 psia. Typically, the stream of withdrawn refrigerant in conduit 109*a* can have a nitrogen concentration in the range of from about 0.01 to about 35 mole percent, about 0.5 to about 20 mole percent, about 1 to about 15 mole percent, or 1.5 to 10 mole percent nitrogen, based on the total moles of the stream in conduit 109*a*.

When the stream in conduit 109*a* enters fuel gas separator 25 via conduit 109*b*, methane and other hydrocarbons preferentially permeate through the membrane to thereby form a nitrogen-depleted permeate stream and a nitrogen-rich retentate stream. In one embodiment, the molar ratio of the nitrogen content of the nitrogen-rich retentate to the nitrogen content of the feed stream entering fuel gas separator 25 can be greater than about 0.55:1, greater than about 0.65:1, greater than about 0.75:1, or greater than 0.9:1. Typically, the nitrogen-depleted permeate stream in conduit 108*a* can have a nitrogen content less than about 5 mole percent, less than about 2 mole percent, less than about 1 mole percent, or less than 0.25 mole percent. During steady-state operation of the LNG facility, the permeate stream exiting fuel gas separator 25 can be routed back to open-loop refrigeration cycle 15 via conduit 108*c* for use as a refrigerant, as shown in FIG. 1. At least a portion of the nitrogen-rich retentate stream in conduit 100*b*, which can have a nitrogen content greater than about 15 mole percent, greater than about 25 mole percent, or greater than about 50 mole percent, based on the total moles of the retentate stream, can be utilized as a fuel gas stream within the LNG facility.

Although the compositions of the feed streams processed by fuel gas separator 25 during start-up and steady-state operation of the LNG facility can vary widely, the composition of the respective retentate streams (i.e., the fuel gas streams) can remain relatively constant. Modified Wobbe Index (MWI) is a common property used to quantify the composition of fuel gas within an LNG facility. The MWI is a measure of the fuel energy flow rate through a fixed orifice under given inlet conditions. The MWI can be expressed according to the following formula: MWI=LHV/(SG×Ta)−0.5, wherein the LHV is the lower heating value of the gas in BTU/SCF, SG is the specific gravity of the fuel relative to air at ISO (1 atm, 70° F.) conditions, and Ta is the absolute temperature. In one embodiment, the MWI of the lights stream (i.e., fuel gas stream) exiting fuel gas separator 25 can be in the range of from about 25 to about 75 BTU per standard cubic foot per degree Rankin0.5 (BTU/SCF.°R0.5), about 35 to about 60 BTU/SCF.°R0.5, or 40 to 55 BTU/SCF.°R0.5.

Typically, the difference between the MWI of the feed streams processed by fuel gas separator 25 during the start-up and the steady-state modes of operation of the LNG facility can be greater than the difference in the MWI of the respective fuel gas streams (i.e., lights streams) exiting fuel gas separator 25. In one embodiment, the difference in the respective MWIs of the fuel gas streams produced during start-up and steady-state operation of the LNG facility can be less than about 10 percent, less than about 5 percent, less than about 2 percent, or less than 1 percent. Producing fuel gas having a substantially consistent composition can help decrease the capital and operating costs of the overall LNG facility. For example, an LNG facility producing consistent fuel gas can employ gas turbines having a single nozzle configuration, which greatly reduces the capital cost and operating complexity associated with the large, expensive, and complex turbines.

In addition, the LNG facility depicted in FIG. 1 is shiftable between the above-described start-up and steady-state configurations. In one embodiment, a flow control system, represented herein by valves 27*a,b* and 28*a,b*, can be employed to shift the LNG facility between the start-up and steady-state modes of operation. During the start-up mode of operation, the natural gas feed conduit 100 is in fluid flow communication with the feed inlet to fuel gas separator 25 through valve 27*a* and the heavies (i.e., permeate) outlet of fuel gas separator 25 is in fluid communication with the hydrocarbon disposal device (e.g., the flare) via valve 28*a*. During the steady-state mode of operation, third refrigeration cycle 15 is in fluid flow communication with the feed gas inlet of fuel gas separator 25 via valve 27*b* and the heavies outlet of fuel gas separator 25 is in fluid communication with third refrigeration cycle 15 via valve 28*b*. To switch the LNG facility from the start-up mode of operation to the steady-state mode of operation, valves 27*a* and 28*a* can be closed to decouple the feed inlet to fuel gas separator 25 from natural gas feed conduit 100 and the heavies outlet of fuel gas separator 25 from the hydrocarbon disposal device, while valves 27*b* and 28*b* can be opened to establish fluid flow communication between third refrigeration cycle 15 and fuel gas separator 25.

Figure 2:
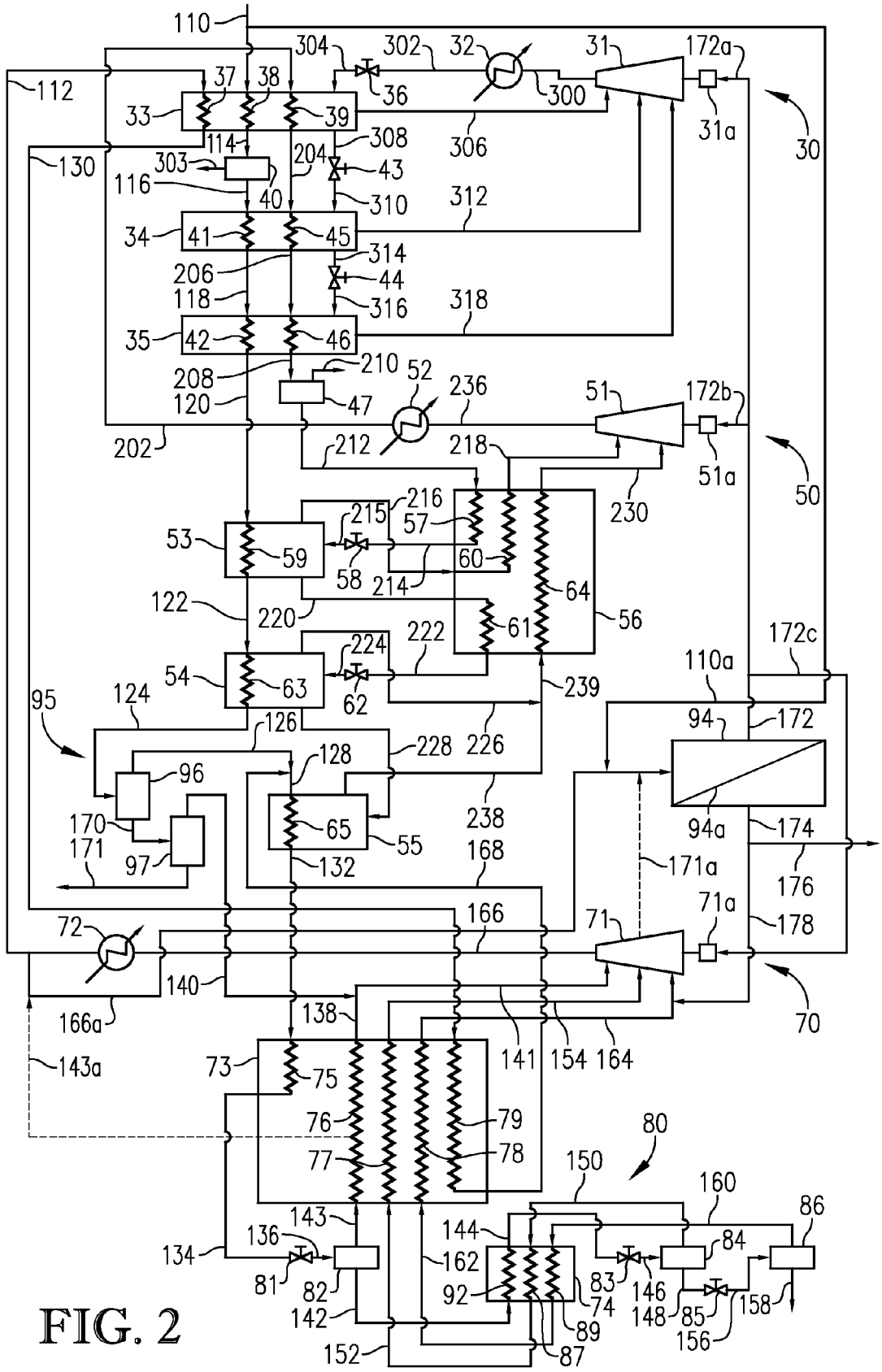
FIG. 2 is a schematic diagram a cascade-type LNG facility configured in accordance with one embodiment of present invention.

FIG. 2 presents one embodiment of a specific configuration of the LNG facility described previously with respect to FIG. 1. To facilitate an understanding of FIG. 2, the following numeric nomenclature was employed. Items numbered 31 through 49 are process vessels and equipment directly associated with first propane refrigeration cycle 30, and items numbered 51 through 69 are process vessels and equipment related to second ethylene refrigeration cycle 50. Items numbered 71 through 94 correspond to process vessels and equipment associated with third methane refrigeration cycle 70 and/or expansion section 80. Items numbered 96 through 99 are process vessels and equipment associated with heavies removal zone 95. Items numbered 100 through 199 correspond to flow lines or conduits that contain predominantly methane streams. Items numbered 200 through 299 correspond to flow lines or conduits which contain predominantly ethylene streams. Items numbered 300 through 399 correspond to flow lines or conduits that contain predominantly propane streams.

Referring now to FIG. 2, a cascade-type LNG facility in accordance with one embodiment of the present invention is illustrated. The LNG facility depicted in FIG. 2 generally comprises a propane refrigeration cycle 30, a ethylene refrigeration cycle 50, a methane refrigeration cycle 70 with an expansion section 80, and a heavies removal zone 95. While "propane," "ethylene," and "methane" are used to refer to respective first, second, and third refrigerants, it should be understood that the embodiment illustrated in FIG. 2 and described herein can apply to any combination of suitable refrigerants. The main components of propane refrigeration cycle 30 include a propane compressor 31, a gas turbine 31*a*, a propane cooler 32, a high-stage propane chiller 33, an intermediate-stage propane chiller 34, and a low-stage propane chiller 35. The main components of ethylene refrigeration cycle 50 include an ethylene compressor 51, a gas turbine 51*a*, an ethylene cooler 52, a high-stage ethylene chiller 53, an intermediate-stage ethylene chiller 54, a low-stage ethylene chiller/condenser 55, and an ethylene economizer 56. The main components of methane refrigeration cycle 70 include a methane compressor 71, a gas turbine 71*a*, a methane cooler 72, a main methane economizer 73, and a secondary methane economizer 74. The main components of expansion section 80 include a high-stage methane expander 81, a high-stage methane flash drum 82, an intermediate-stage methane expander 83, an intermediate-stage methane flash drum 84, a low-stage methane expander 85, and a low-stage methane flash drum 86. The LNG facility of FIG. 2 also includes heavies removal zone located downstream of intermediate-stage ethylene chiller 54 for removing heavy hydrocarbon components from the processed natural gas and recovering the resulting natural gas liquids. The heavies removal zone 95 of FIG. 2 is shown as generally comprising a first distillation column 96 and a second distillation column 97.

The steady-state operation of the LNG facility illustrated in FIG. 2 will now be described in more detail, beginning with propane refrigeration cycle 30. Propane is compressed in multi-stage (e.g., three-stage) propane compressor 31 driven by, for example, gas turbine 31*a*. The three stages of compression preferably exist in a single unit, although each stage of compression may be a separate unit and the units mechanically coupled to be driven by a single driver. Upon compression, the propane is passed through conduit 300 to propane cooler 32, wherein it is cooled and liquefied via indirect heat exchange with an external fluid (e.g., air or water). A representative temperature and pressure of the liquefied propane refrigerant exiting cooler 32 is about 100° F. and about 190 psia. The stream from propane cooler 32 can then be passed through conduit 302 to a pressure reduction means, illustrated as expansion valve 36, wherein the pressure of the liquefied propane is reduced thereby evaporating or flashing a portion thereof. The resulting two-phase stream then flows via conduit 304 into high-stage propane chiller 33. High stage propane chiller 33 uses indirect heat exchange means 37, 38, and 39 to cool respectively, the incoming gas streams, including a yet-to-be-discussed methane refrigerant stream in conduit 112, a natural gas feed stream in conduit 110, and a yet-to-be-discussed ethylene refrigerant stream in conduit 202 via indirect heat exchange with the vaporizing refrigerant. The cooled methane refrigerant stream exits high-stage propane chiller 33 via conduit 130 and can subsequently be routed to the inlet of main methane economizer 73, which will be discussed in greater detail in a subsequent section.

The cooled natural gas stream from high-stage propane chiller 33 (also referred to herein as the "methane-rich stream") flows via conduit 114 to a separation vessel 40, wherein the gaseous and liquid phases are separated. The liquid phase, which can be rich in propane and heavier components (C3+), is removed via conduit 303. The predominately vapor phase exits separator 40 via conduit 116 and can then enter intermediate-stage propane chiller 34, wherein the stream is cooled in indirect heat exchange means 41 via indirect heat exchange with a yet-to-be-discussed propane refrigerant stream. The resulting two-phase methane-rich stream in conduit 118 can then be routed to low-stage propane chiller 35, wherein the stream can be further cooled via indirect heat exchange means 42. The resultant predominantly methane stream can then exit low-stage propane chiller 34 via conduit 120. Subsequently, the cooled methane-rich stream in conduit 120 can be routed to high-stage ethylene chiller 53, which will be discussed in more detail shortly.

The vaporized propane refrigerant exiting high-stage propane chiller 33 is returned to the high-stage inlet port of propane compressor 31 via conduit 306. The residual liquid propane refrigerant in high-stage propane chiller 33 can be passed via conduit 308 through a pressure reduction means, illustrated here as expansion valve 43, whereupon a portion of the liquefied refrigerant is flashed or vaporized. The resulting cooled, two-phase refrigerant stream can then enter intermediate-stage propane chiller 34 via conduit 310, thereby providing coolant for the natural gas stream and yet-to-be-discussed ethylene refrigerant stream entering intermediate-stage propane chiller 34. The vaporized propane refrigerant exits intermediate-stage propane chiller 34 via conduit 312 and can then enter the intermediate-stage inlet port of propane compressor 31. The remaining liquefied propane refrigerant exits intermediate-stage propane chiller 34 via conduit 314 and is passed through a pressure-reduction means, illustrated here as expansion valve 44, whereupon the pressure of the stream is reduced to thereby flash or vaporize a portion thereof. The resulting vapor-liquid refrigerant stream then enters low-stage propane chiller 35 via conduit 316 and cools the methane-rich and yet-to-be-discussed ethylene refrigerant streams entering low-stage propane chiller 35 via conduits 118 and 206, respectively. The vaporized propane refrigerant stream then exits low-stage propane chiller 35 and is routed to the low-stage inlet port of propane compressor 31 via conduit 318 wherein it is compressed and recycled as previously described.

As shown in FIG. 2, a stream of ethylene refrigerant in conduit 202 enters high-stage propane chiller, wherein the ethylene stream is cooled via indirect heat exchange means 39. The resulting cooled stream in conduit 204 then exits high-stage propane chiller 33, whereafter the at least partially condensed stream enters intermediate-stage propane chiller 34. Upon entering intermediate-stage propane chiller 34, the ethylene refrigerant stream can be further cooled via indirect heat exchange means 45. The resulting two-phase ethylene stream can then exit intermediate-stage propane chiller 34 prior to entering low-stage propane chiller 35 via conduit 206. In low-stage propane chiller 35, the ethylene refrigerant stream can be at least partially condensed, or condensed in its entirety, via indirect heat exchange means 46. The resulting stream exits low-stage propane chiller 35 via conduit 208 and can subsequently be routed to a separation vessel 47, wherein the vapor portion of the stream, if present, can be removed via conduit 210. The liquefied ethylene refrigerant stream exiting separator 47 via conduit 212 can have a representative temperature and pressure of about −24° F. and about 285 psia.

Turning now to ethylene refrigeration cycle 50 in FIG. 2, the liquefied ethylene refrigerant stream in conduit 212 can enter ethylene economizer 56, wherein the stream can be further cooled by an indirect heat exchange means 57. The sub-cooled liquid ethylene stream in conduit 214 can then be routed through a pressure reduction means, illustrated here as expansion valve 58, whereupon the pressure of the stream is reduced to thereby flash or vaporize a portion thereof. The cooled, two-phase stream in conduit 215 can then enter high-stage ethylene chiller 53, wherein at least a portion of the ethylene refrigerant stream can vaporize to thereby cool the methane-rich stream entering an indirect heat exchange means 59 of high-stage ethylene chiller 53 via conduit 120. The vaporized and remaining liquefied refrigerant exit high-stage ethylene chiller 53 via respective conduits 216 and 220. The vaporized ethylene refrigerant in conduit 216 can re-enter ethylene economizer 56, wherein the stream can be warmed via an indirect heat exchange means 60 prior to entering the high-stage inlet port of ethylene compressor 51 via conduit 218, as shown in FIG. 2.

The remaining liquefied refrigerant in conduit 220 can re-enter ethylene economizer 56, wherein the stream can be further sub-cooled by an indirect heat exchange means 61. The resulting cooled refrigerant stream exits ethylene economizer 56 via conduit 222 and can subsequently be routed to a pressure reduction means, illustrated here as expansion valve 62, whereupon the pressure of the stream is reduced to thereby vaporize or flash a portion thereof. The resulting, cooled two-phase stream in conduit 224 enters intermediate-stage ethylene chiller 54, wherein the refrigerant stream can cool the natural gas stream in conduit 122 entering intermediate-stage ethylene chiller 54 via an indirect heat exchange means 63. As shown in FIG. 2, the resulting cooled methane-rich stream exiting intermediate stage ethylene chiller 54 can then be routed to heavies removal zone 95 via conduit 124. Heavies removal zone 95 will be discussed in detail in a subsequent section.

The vaporized ethylene refrigerant exits intermediate-stage ethylene chiller 54 via conduit 226, whereafter the stream can combine with a yet-to-be-discussed ethylene vapor stream in conduit 238. The combined stream in conduit 239 can enter ethylene economizer 56, wherein the stream is warmed in an indirect heat exchange means 64 prior to being fed into the low-stage inlet port of ethylene compressor 51 via conduit 230. Ethylene is compressed in multi-stage (e.g., three-stage) ethylene compressor 51 driven by, for example, gas turbine driver 51*a*. The three stages of compression preferably exist in a single unit, although each stage of compression may be a separate unit and the units mechanically coupled to be driven by a single driver. As shown in FIG. 2, a stream of compressed ethylene refrigerant in conduit 236 can subsequently be routed to ethylene cooler 52, wherein the ethylene stream can be cooled via indirect heat exchange with an external fluid (e.g., water or air). The resulting, at least partially condensed ethylene stream can then be introduced via conduit 202 into high-stage propylene chiller 33 for additional cooling as previously described.

The remaining liquefied ethylene refrigerant exits intermediate-stage ethylene chiller 54 via conduit 228 prior to entering low-stage ethylene chiller/condenser 55, wherein the refrigerant can cool the methane-rich stream entering low-stage ethylene chiller/condenser via conduit 128 in an indirect heat exchange means 65. In one embodiment shown in FIG. 2, the stream in conduit 128 results from the combination of a heavies-depleted (i.e., light hydrocarbon rich) stream exiting heavies removal zone 95 via conduit 126 and a yet-to-be-discussed methane refrigerant stream in conduit 168. As shown in FIG. 2, the vaporized ethylene refrigerant can then exit low-stage ethylene chiller/condenser 55 via conduit 238 prior to combining with the vaporized ethylene exiting intermediate-stage ethylene chiller 54 and entering the low-stage inlet port of ethylene compressor 51, as previously discussed.

The cooled natural gas stream exiting low-stage ethylene chiller/condenser can also be referred to as the "pressurized LNG-bearing stream." As shown in FIG. 2, the pressurized LNG-bearing stream exits low-stage ethylene chiller/condenser 55 via conduit 132 prior to entering main methane economizer 73. In main methane economizer 73, the methane-rich stream can be cooled in an indirect heat exchange means 75 via indirect heat exchange with one or more yet-to-be discussed methane refrigerant streams. The cooled, pressurized LNG-bearing stream exits main methane economizer 73 and can then be routed via conduit 134 into expansion section 80 of methane refrigeration cycle 70. In expansion section 80, the cooled predominantly methane stream passes through high-stage methane expander 81, whereupon the pressure of the stream is reduced to thereby vaporize or flash a portion thereof. The resulting two-phase methane-rich stream in conduit 136 can then enter high-stage methane flash drum 82, whereupon the vapor and liquid portions can be separated. The vapor portion exiting high-stage methane flash drum 82 (i.e., the high-stage flash gas) via conduit 143 can then enter main methane economizer 73, wherein the stream is heated via indirect heat exchange means 76. The resulting warmed vapor stream exits main methane economizer 73 and subsequently combines with a yet-to-be-discussed vapor stream exiting heavies removal zone 95 in conduit 140. The combined stream in conduit 141 can then be routed to the high-stage inlet port of methane compressor 71, as shown in FIG. 2.

The liquid phase exiting high-stage methane flash drum 82 via conduit 142 can enter secondary methane economizer 74, wherein the methane stream can be cooled via indirect heat exchange means 92. The resulting cooled stream in conduit 144 can then be routed to a second expansion stage, illustrated here as intermediate-stage expander 83. Intermediate-stage expander 83 reduces the pressure of the methane stream passing therethrough to thereby reduce the stream's temperature to thereby vaporize or flash a portion thereof. The resulting two-phase methane-rich stream in conduit 146 can then enter intermediate-stage methane flash drum 84, wherein the liquid and vapor portions of the stream can be separated and can exit the intermediate-stage flash drum via respective conduits 148 and 150. The vapor portion (i.e., the intermediate-stage flash gas) in conduit 150 can re-enter secondary methane economizer 74, wherein the stream can be heated via an indirect heat exchange means 87. The warmed stream can then be routed via conduit 152 to main methane economizer 73, wherein the stream can be further warmed via an indirect heat exchange means 77 prior to entering the intermediate-stage inlet port of methane compressor 71 via conduit 154.

The liquid stream exiting intermediate-stage methane flash drum 84 via conduit 148 can then pass through a low-stage expander 85, whereupon the pressure of the liquefied methane-rich stream can be further reduced to thereby vaporize or flash a portion thereof. The resulting cooled, two-phase stream in conduit 156 can then enter low-stage methane flash drum 86, wherein the vapor and liquid phases can be separated. The liquid stream exiting low-stage methane flash drum 86 can comprise the liquefied natural gas (LNG) product. The LNG product, which is at about atmospheric pressure, can be routed via conduit 158 downstream for subsequent storage, transportation, and/or use.

The vapor stream exiting low-stage methane flash drum (i.e., the low-stage methane flash gas) in conduit 160 can be routed to secondary methane economizer 74, wherein the stream can be warmed via an indirect heat exchange means 89. The resulting stream can exit secondary methane economizer 74 via conduit 162, whereafter the stream can be routed to main methane economizer 73 to be further heated via indirect heat exchange means 78. The warmed methane vapor stream can then exit main methane economizer 73 via conduit 164 prior to being routed to the low-stage inlet port of methane compressor 71. Methane compressor 71 can comprise one or more compression stages. In one embodiment, methane compressor 71 comprises three compression stages in a single module. In another embodiment, the compression modules can be separate, but can be mechanically coupled to a common driver. Generally, when methane compressor 71 comprises two or more compression stages, one or more intercoolers (not shown) can be provided between subsequent compression stages. As shown in FIG. 2, the compressed methane refrigerant stream exiting methane compressor 71 can be discharged into conduit 166, whereafter the stream can be cooled via indirect heat exchange with an external fluid (e.g., air or water) in methane cooler 72. The cooled methane refrigerant stream exiting methane cooler 72 can then enter conduit 112, whereafter the stream can be split into two portions. The first portion continues via conduit 112 on to propane refrigeration cycle 30 to be cooled further, as discussed in detail previously.

The second portion of the cooled compressed methane refrigerant stream enters conduit 166*a* and can thereafter be transported to the inlet of a fuel gas separator 94, which employs a hydrocarbon-separating membrane 94*a*. The methane and other hydrocarbon components can preferentially permeate hydrocarbon-separating membrane 94*a* over the nitrogen in the feed gas stream. As illustrated in FIG. 2, the nitrogen-depleted (i.e., methane-rich) permeate stream exiting the outlet of fuel gas separator 94 via conduit 174 can be routed back to the open-loop methane refrigeration cycle via conduit 178 and can combine with the methane refrigerant stream in conduit 164 prior to entering the low-stage inlet port of methane compressor 71. The nitrogen-rich retentate stream exiting fuel gas separator 94 via conduit 172 can be routed to gas turbines 31*a*, 51*a*, and/or 71*a* via respective conduits 172*a*, 172*b*, and 172*c* and can be used as fuel gas to respectively power propane, ethylene, and methane compressors 31, 51, and 71. Alternatively, nitrogen-containing streams to be processed in fuel gas separator 94 can be withdrawn from the high-stage flash vapor indirect heat exchange means 76 via conduit 143*a* or from the outlet of the intermediate stage of methane compressor 71 via conduit 171*a*.

Turning now to the portion of the methane refrigerant entering propane refrigeration cycle 30 via conduit 112, upon being cooled via indirect heat exchange with the vaporizing propane refrigerant, the methane refrigerant stream in conduit 112 can be discharged into conduit 130 and subsequently routed to main methane economizer 73, wherein the stream can be further cooled via indirect heat exchange means 79. The resulting sub-cooled stream exits main methane economizer 73 via conduit 168 and can then combined with the heavies-depleted stream exiting heavies removal zone 95 via conduit 126, as previously discussed.

Turning now to heavies removal zone 95, the cooled, at least partially condensed effluent exiting intermediate-stage ethylene chiller 54 via conduit 124 can be routed into the inlet of first distillation column 96, as shown in FIG. 2. A predominantly methane overhead vapor product stream can exit an upper outlet of first distillation column 96 via conduit 126. As discussed previously, the stream in conduit 126 can subsequently combine with the methane refrigerant stream in conduit 168 prior to entering low-stage ethylene chiller/condenser 55 via conduit 128. Referring back to heavies removal zone 95, a heavies-rich bottoms liquid product stream exiting a lower outlet of first distillation column 96 via conduit 170 can then be routed to an inlet of second distillation column 97. An overhead vapor product stream can exit an upper outlet of second distillation column 97 via conduit 140 prior to being combined with the warmed methane refrigerant stream in conduit 138, as discussed in detail previously. The bottoms liquid product exiting a lower outlet of second distillation column 97 can comprise the natural gas liquids (NGL) product. The NGL product, which can comprise a significant concentration of butane and heavier hydrocarbons, such as benzene, cyclohexane, and other aromatics, can be routed to further storage, processing, and/or use via conduit 171.

When the LNG facility depicted in FIG. 2 is operated in start-up mode, a fraction of the natural gas stream in conduit 110 can be withdrawn via conduit 110*a* and routed to the inlet of fuel gas separator 94, wherein at least a portion of the stream can pass through hydrocarbon-separating membrane 94*a*. The resulting heavies-depleted retentate stream in conduit 172 can be burned as fuel gas in gas turbines 31*a*, 51*a*, and 71*a* in order to respectively power propane, ethylene, and methane compressors 31, 51, and 71. The heavies-rich permeate stream can exit fuel gas separator 94 via conduit 174 and can thereafter be routed to the flare (not shown) or other hydrocarbon disposal device via conduit 176. In one embodiment of the present invention, the LNG production systems illustrated in FIGS. 1 and 2 are simulated on a computer using conventional process simulation software in order to generate process simulation data in a human-readable form. In one embodiment, the process simulation data can be in the form of a computer print out. In another embodiment, the process simulation data can be displayed on a screen, a monitor, or other viewing device. The simulation data can then be used to manipulate the LNG system. In one embodiment, the simulation results can be used to design a new LNG facility and/or revamp or expand an existing facility. In another embodiment, the simulation results can be used to optimize the LNG facility according to one or more operating parameters. Examples of suitable software for producing the simulation results include HYSYS™ or Aspen Plus.RTM. from Aspen Technology, Inc., and PRO/II.RTM. from Simulation Sciences Inc.

Numerical Ranges

The present description uses numerical ranges to quantify certain parameters relating to the invention. It should be understood that when numerical ranges are provided, such ranges are to be construed as providing literal support for claim limitations that only recite the lower value of the range as well as claims limitation that only recite the upper value of the range. For example, a disclosed numerical range of 10 to 100 provides literal support for a claim reciting "greater than 10" (with no upper bounds) and a claim reciting "less than 100" (with no lower bounds).

DEFINITIONS

As used herein, the terms "a," "an," "the," and "said" means one or more.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

As used herein, the term "cascade-type refrigeration process" refers to a refrigeration process that employs a plurality of refrigeration cycles, each employing a different pure component refrigerant to successively cool natural gas.

As used herein, the term "closed-loop refrigeration cycle" refers to a refrigeration cycle wherein substantially no refrigerant enters or exits the cycle during normal operation.

As used herein, the terms "comprising," "comprises," and "comprise" are open-ended transition terms used to transition from a subject recited before the term to one or elements recited after the term, where the element or elements listed after the transition term are not necessarily the only elements that make up of the subject.

As used herein, the terms "containing," "contains," and "contain" have the same open-ended meaning as "comprising," "comprises," and "comprise," provided below.

As used herein, the term "depleted," when used in reference to a product stream, indicates that the product stream comprises a relatively lower amount of a certain component than the feed stream from which the product stream originated.

As used herein, the terms "economizer" or "economizing heat exchanger" refer to a configuration utilizing a plurality of heat exchangers employing indirect heat exchange means to efficiently transfer heat between process streams.

As used herein, the terms "having," "has," and "have" have the same open-ended meaning as "comprising," "comprises," and "comprise," provided above.

As used herein, the terms "heavy hydrocarbon" and "heavies" refers to any components that are less volatile (i.e., has a higher boiling point) than methane.

As used herein, the terms "including," "includes," and "include" have the same open-ended meaning as "comprising," "comprises," and "comprise," provided above.

As used herein, the term "light hydrocarbon" or "lights" refers to any components that are more volatile (i.e., have a lower boiling point) than methane.

As used herein, the term "mid-range standard boiling point" refers to the temperature at which half of the weight of a mixture of physical components has been vaporized (i.e., boiled off) at standard pressure.

As used herein, the term "mixed refrigerant" refers to a refrigerant containing a plurality of different components, where no single component makes up more than 75 mole percent of the refrigerant.

As used herein, the term "natural gas" means a stream containing at least 75 mole percent methane, with the balance being ethane, higher hydrocarbons, nitrogen, carbon dioxide, and/or a minor amount of other contaminants such as mercury, hydrogen sulfide, and mercaptan.

As used herein, the terms "natural gas liquids" or "NGL" refer to mixtures of hydrocarbons whose components are, for example, typically heavier than ethane. Some examples of hydrocarbon components of NGL streams include propane, butane, and pentane isomers, benzene, toluene, and other aromatic compounds.

As used herein, the term "open-loop refrigeration cycle" refers to a refrigeration cycle wherein at least a portion of the refrigerant employed during normal operation originates from the fluid being cooled by the refrigeration cycle.

As used herein, the terms "predominantly," "primarily," "principally," and "in major portion," when used to describe the presence of a particular component of a fluid stream, means that the fluid stream comprises at least 50 mole percent of the stated component. For example, a "predominantly" methane stream, a "primarily" methane stream, a stream "principally" comprised of methane, or a stream comprised "in major portion" of methane each denote a stream comprising at least 50 mole percent methane.

As used herein, the term "pure component refrigerant" means a refrigerant that is not a mixed refrigerant.

As used herein, the term "rich," when used in reference to a product stream, indicates that the product stream comprises a relatively higher amount of a certain component than the feed stream from which the product stream originated.

As used herein, the terms "upstream" and "downstream" refer to the relative positions of various components of a natural gas liquefaction facility along the main flow path of natural gas through the facility.

Claims not Limited to Disclosed Embodiments

The preferred forms of the invention described above are to be used as illustration only, and should not be used in a limiting sense to interpret the scope of the present invention. Modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A process for liquefying a natural gas stream in an LNG facility, said process comprising:

(a) separating a first predominantly methane stream into a first lights stream and a first heavies stream in a fuel gas separator;

(b) burning a first fuel gas stream comprising at least a portion of said first lights stream in a gas turbine;

(c) separating a second predominantly methane stream into a second lights stream and a second heavies stream in said fuel gas separator; and (d) burning a second fuel gas stream comprising at least a portion of said second lights stream in said gas turbine, wherein the difference in Modified Wobbe Index (MWI) between said first and said second lights streams is less than the difference in MWI between said first and said second predominantly methane streams; wherein said first predominantly methane stream and said second predominantly methane stream share a first single conduit into said fuel gas separator, wherein said first lights stream and said second lights stream share a first single conduit from said fuel gas separator, and wherein said first heavies stream and said second heavies stream share a second single conduit from said fuel gas separator, wherein said first predominantly methane stream is delivered directly to said fuel gas separator before entering any chiller and said second predominantly methane stream is delivered to said fuel gas separator after passing through a chiller of a propane refrigeration cycle, a chiller of an ethylene refrigeration cycle, and an economizer of a methane refrigeration cycle, further comprising separating at least a portion of said natural gas stream in a heavies removal zone of said LNG facility, wherein said first predominantly methane stream comprises a fraction of said natural gas stream withdrawn upstream of said heavies removal zone, and wherein said second predominantly methane stream comprises a fraction of said natural gas stream withdrawn downstream of said heavies removal zone.

2. The process of claim 1, wherein steps (a) and (b) are carried out during start-up of said LNG facility, wherein steps (c) and (d) are carried out during substantially steady-state operation of said LNG facility.

3. The process of claim 1, wherein said second predominantly methane stream comprises a fraction of a predominantly methane refrigerant withdrawn from an open-loop methane refrigeration cycle of said LNG facility, wherein said first predominantly methane stream comprises a fraction of said natural gas stream withdrawn upstream of said open-loop methane refrigeration cycle.

4. The process of claim 1, further comprising cooling at least a portion of said natural gas stream in a first refrigeration cycle via indirect heat exchange with a first refrigerant, wherein said first predominantly methane stream comprises a fraction of said natural gas stream withdrawn upstream of said first refrigeration cycle, wherein said second predominantly methane stream comprises a fraction of said natural gas stream withdrawn downstream of said first refrigeration cycle.

5. The process of claim 4, wherein said first refrigerant comprises predominantly propane, propylene, ethane, and/or ethylene.

6. The process of claim 4, wherein said first refrigeration cycle comprises a refrigerant compressor driven by said gas turbine.

7. The process of claim 1, wherein said LNG facility employs successive propane, ethylene, and methane refrigeration cycles, wherein at least one of said refrigeration cycles comprises a refrigerant compressor driven by said gas turbine.

8. The process of claim 1, wherein said first fuel gas stream and said second fuel gas stream are injected into said gas turbine through the same set of nozzles.

9. The process of claim 1, wherein said fuel gas separator comprises a hydrocarbon-separating membrane.

10. The process of claim 9, wherein said membrane has a methane-to-nitrogen selectivity greater than about 1.5 and a transmembrane methane flux of at least about $1\times10^6$ $cm^3$ (STP)/$cm^2$·s·cmHg at 75° F.

11. The process of claim 1, wherein the difference in MWI between said first and said second lights streams is less than about 10 percent.

12. The process of claim 11, wherein said first and said second lights streams have an MWI in the range of from about 25 to about 75 BTU/SCF.° R0.5.

13. The process of claim 1, wherein the molar ratio of the C2+ content in said first lights stream to the C2+ content in said first predominantly methane stream is less than about 0.45:1, wherein the molar ratio of the nitrogen content in said second lights stream to the nitrogen content in said second predominantly methane stream is greater than about 0.55:1.

14. The process of claim 1, wherein said first and/or said second predominantly methane streams entering said fuel gas separator have a temperature in the range of from about 0 to about 200° F. and a pressure in the range of from about 250 to about 1,000 psia, wherein said first and/or second heavies streams exiting said fuel gas separator have a pressure in the range of from about 50 to about 150 psia.

15. The process of claim 1, further comprising vaporizing liquefied natural gas produced via steps (a)-(d).

16. The process of claim 1, further comprising:

utilizing a computer to create a simulation utilizing said process of claim 1; and generating process simulation data from said simulation in a human-readable, computer print-out.

* * * * *